US007952031B2

(12) United States Patent
Hammer et al.

(10) Patent No.: US 7,952,031 B2
(45) Date of Patent: May 31, 2011

(54) BARRIER SYSTEM FOR THE LINE BUSHING OF AN ELECTRICAL INSTALLATION

(75) Inventors: Thomas Hammer, Schwabach (DE); Peter Heinzig, Wendelstein (DE); Jens Hoppe, Schwarzenbruck (DE); Dietmar Jahnel, Nürnberg (DE); Johann Schlager, Nürnberg (DE); Lambert Schummer, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 775 days.

(21) Appl. No.: 11/913,516

(22) PCT Filed: Apr. 28, 2006

(86) PCT No.: PCT/EP2006/061907

§ 371 (c)(1),
(2), (4) Date: Nov. 2, 2007

(87) PCT Pub. No.: WO2006/117333

PCT Pub. Date: Nov. 9, 2006

(65) Prior Publication Data

US 2009/0000805 A1 Jan. 1, 2009

(30) Foreign Application Priority Data

May 2, 2005 (DE) ..... 10 2005 021 255

(51) Int. Cl.
*H01B 17/26* (2006.01)
*H01F 27/04* (2006.01)

(52) U.S. Cl. ..... 174/142; 174/152 R; 174/135; 16/2.1; 16/2.2

(58) Field of Classification Search ..... 174/142, 174/650, 135, 152 R, 152 G, 153 G, 73.1, 174/167, 74 R, 137 R, 31 R; 16/2.1, 2.2; 248/49

See application file for complete search history.

(56) References Cited

U.S. PATENT DOCUMENTS

| | | | | |
|---|---|---|---|---|
| 2,667,532 | A * | 1/1954 | Ewer | 174/142 |
| 3,769,446 | A | 10/1973 | Martincic et al. | |
| 4,370,514 | A * | 1/1983 | Matthaus et al. | 174/73.1 |
| 4,774,385 | A * | 9/1988 | Toshima | 174/142 |
| 5,227,584 | A * | 7/1993 | Holmstrom et al. | 174/73.1 |

FOREIGN PATENT DOCUMENTS

| | | |
|---|---|---|
| BE | 639021 | 10/1963 |
| DE | 1 051 432 | 2/1959 |
| DE | 1 156 135 | 10/1963 |
| DE | 1 208 782 | 1/1966 |
| DE | 23 61 220 | 6/1975 |
| DE | 690 12 258 T2 | 4/1995 |
| EP | 0 413 103 A1 | 2/1991 |
| EP | 0 413 103 B1 | 9/1994 |
| GB | 1 487 229 | 9/1977 |

* cited by examiner

*Primary Examiner* — Angel R Estrada

(74) *Attorney, Agent, or Firm* — Laurence A. Greenberg; Werner H. Stemer; Ralph E. Locher

(57) ABSTRACT

A barrier system for a line leadthrough in an electric installation has mutually adjacent wall elements forming barriers that extend in an axial longitudinal direction and are spaced apart from each other, forming channels. The wall elements lie partially on a support, at least at their lower ends. The wall elements are joined by a plug element to the leadthrough. Slots having a width which corresponds to the wall thickness of the wall elements are arranged in the plug element. The wall elements can be inserted into the slots, thus permitting a barrier system to be quickly and easily assembled and disassembled.

17 Claims, 2 Drawing Sheets

BARRIER SYSTEM FOR THE LINE BUSHING OF AN ELECTRICAL INSTALLATION

BACKGROUND OF THE INVENTION

Field of the Invention

The invention relates to a barrier system for a line bushing of an electrical installation, having wall elements as barriers, which are arranged alongside one another, have axial longitudinal extents and are arranged in intervals from one another, with the intermediate spaces therefore forming channels, with the wall elements resting in places on a base at least with the lower end of the wall elements. The invention also relates to a plug element for holding and fixing the wall elements which form the barrier.

The background to the present invention is barrier systems for line bushing of an electrical installation, in particular for high-voltage installations. Particularly in the case of high-voltage installations, the connection of the electrical installation to an external line network requires a shielding line bushing in the connection area between the electrical installation and the external network. In this case, an insulation body is conventionally arranged around an electrode and withstands the electrical and thermal load in the line bushing area. Pressboard segments are for this purpose arranged—generally coaxially—around the coaxial line bushing. A defined distance is fixed between the pressboard segments, by means of spacing elements. An insulation medium—for example a transformer oil—circulates through the cavities created in this way and is used on the one hand as an insulator, and at the same time as a cooling medium. As a result of the high electrical field strengths in line bushings of an electrical high-voltage installation, the cavities—and therefore the insulated medium circulating in the cavities—must be chosen such that, depending on the distance to the line bushing, they withstand the electrical field and ensure adequate heat circulation around the line bushing. The various field profiles and therefore the electrical field strengths are governed by the form of the voltage applied and by the way in which the electrical installation is operated, for example with a uniform field distribution in the case of DC voltage loads being advantageous for high-voltage DC transmission installations. The distance between the pressboard segments must be chosen and permanently fixed as a function of the profile of the electrical equipotential lines to be expected and of the electrical field strengths which occur as a result of them. Particularly in the immediate vicinity of the line bushing, the relative distances between the pressboard segments must be chosen to be small, and must be chosen to be greater as the field strength in the area outside the line bushing decreases.

Because of the high electrical voltages, exact orientation and fixing of the wall elements as barriers are necessary, in particular in the immediate area of the line bushing. A barrier normally has a length of up to 3 m with a wall thickness of 3 to 6 mm, in which case a maximum position tolerance of 1 mm must be maintained.

These barrier systems are used in particular for transformers and induction coils, as well as for test barrier systems. Barrier systems are known from the prior art which are fitted directly to the line bushing of the electrical installation, and are adhesively bonded to it.

DE 690 12 258 T2 describes capacitor isolation for field control of the connection of a transformer line bushing. As described in the invention there, a system which comprises axially extending cooling channels is disclosed, in addition to a capacitor isolating wall, around the line bushing of an electrical installation. The corresponding insulation of the line bushing is wound on in the course of a winding process, and is therefore permanently fixed. It is impossible to subsequently remove this barrier system from the line bushing.

DE 27 40 157 discloses a line bushing with a control electrode for high-voltage installations. A link to hold the line bushing conductor relative to the electrode is disclosed in particular for metal-encapsulated and compressed-gas-insulated high-voltage installations with a line bushing conductor. DE 27 40 157 discloses no further features relating to the insulation of the line bushing that is required for this purpose.

The same applies to DE 36 16 243 C2 as a line bushing in particular for high voltages. The invention there discloses a union insulator which is filled with an inert gas at low pressure and, by means of insulating perforated discs, separates the high gas pressure on the appliance side from the gas pressure within the union insulator in a gas-tight manner.

Pressboard segments are conventionally arranged at defined distances by means of spacers coaxially around a line bushing. A base for the pressboard segments is placed in the immediate transition area of the electrode which shields the line bushing and a constant separation between the pressboard segments is ensured over the entire length of the pressboard segments, by means of spacers. The pressboard segments are then permanently fixed on the base by means of an adhesive.

BRIEF SUMMARY OF THE INVENTION

The object of the present invention is therefore to overcome the disadvantages which occur in the prior art and to provide a barrier system which can be fitted and removed quickly and easily.

The object is achieved by the subject matter of Patent Claim 1.

The invention provides that a plug element forms the base to which the wall elements can be connected, with the plug element having axial guide elements for holding and fixing the wall elements. The wall elements and the plug element are preferably rotationally symmetrical. In contrast to the prior art, the barrier system according to the invention ensures quick connection, which in particular can subseqently be detached again, of the wall elements to one another, and therefore of the barrier system. In this case, the plug element has axial guide elements, with the at least one axial guide ideally providing axial and radial fixing to the wall elements.

In one advantageous refinement of the invention, the guide elements are arranged on the plug element such that the wall elements which can be connected to the guide elements are at a predetermined distance from one another. Since the high electrical field strengths necessitate exact compliance with the distances between the wall elements which are arranged relative to one another, the arrangement of the guide elements on the plug element ensures that the wall elements are permanently held in a fixed predetermined manner with respect to their relative separations.

A further advantage is that the cap areas of the guide elements are arranged as the base at different heights relative on the plug element, and the wall elements are therefore axially staggered relative to one another. Particularly when using a plurality of wall elements at different distances from the line bushing, it may be necessary for the wall elements to be differently staggered in the axial direction relative to the line bushing. Differently staggered guide elements on the plug element allow an axially staggered arrangement of the wall elements without any problems. The plug element advantageously has slots as guide elements, into which the wall elements, with wall thicknesses which correspond to the slot width, can be plugged. On the one hand, this results in the capability to produce a barrier system quickly and easily. On the other hand, this results in the capability to remove the barrier system again, without major effort.

One advantageous refinement of the invention is for the wall elements to be combined to form plug groups, some of which can be connected to the plug element. The combination of the wall elements to form plug groups means that it is not necessary to add each wall element individually to a barrier system. The use of a plug group comprising a plurality of wall elements provides a simple and quick capability to produce a barrier system. Advantageously, not only can the plug groups be connected to the plug element, but it is also possible for the plug groups themselves to be connected to one another. The strength and dimensional stability of the plug groups, which are combined by means of spacers, and of the wall elements, in particular, allow the groups to be plugged into one another without any problems and easily. The wall elements of the second plug group can be plugged into the intermediate spaces that exist between the wall elements of the first plug group. The choice of a slightly smaller width for the intermediate spaces of the second plug group in comparison to the first plug group allows the second plug group to be fitted and fixed in the first plug group with an accurate fit. The wall elements are advantageously composed completely or partially of pressboard segments. In order to produce an even firmer connection between the wall elements and the plug element, the wall elements are fixed to the guide elements by attachment means, such as (rivets) pins and screws.

In one preferred embodiment, not only is it possible to plug the wall elements into the plug element but, on the other hand, the plug element per se can be connected by means of corresponding holders to the electrode via guide elements, in particular slots. For this purpose, a plug part which corresponds to the guide element must be fitted in the outer area of the electrode.

The guide elements are advantageously shaped such that they do not influence, or only slightly influence, the circulation of a medium located between the wall elements. This is ensured in particular by inclined and rounded shapes. It is also advantageous for the plug element to be arranged as a circumferential ring around the line bushing. If a medium has to circulate only above the plug element, a plug element which can be used as the circumferential ring can be used in order to improve the mechanical connection of the wall elements. Alternatively, flat plug elements distributed around the line bushing can be used to hold and fix the wall elements, and at the same time do not influence the circulation of the medium, which runs along the plug elements, within the wall elements.

The object is likewise achieved by the subject matter of patent claim 14. The invention in this case provides for the capability for at least some of the wall elements to be connected to the plug element, with the plug element having axial guide elements. Slots are advantageously used as axial guide elements, into which corresponding wall elements can be plugged.

Further advantageous refinements can be found in the dependent claims. The subject matter of the invention will be explained in detail with reference to the following figures, in which:

DESCRIPTION OF THE INVENTION

Figure 1:
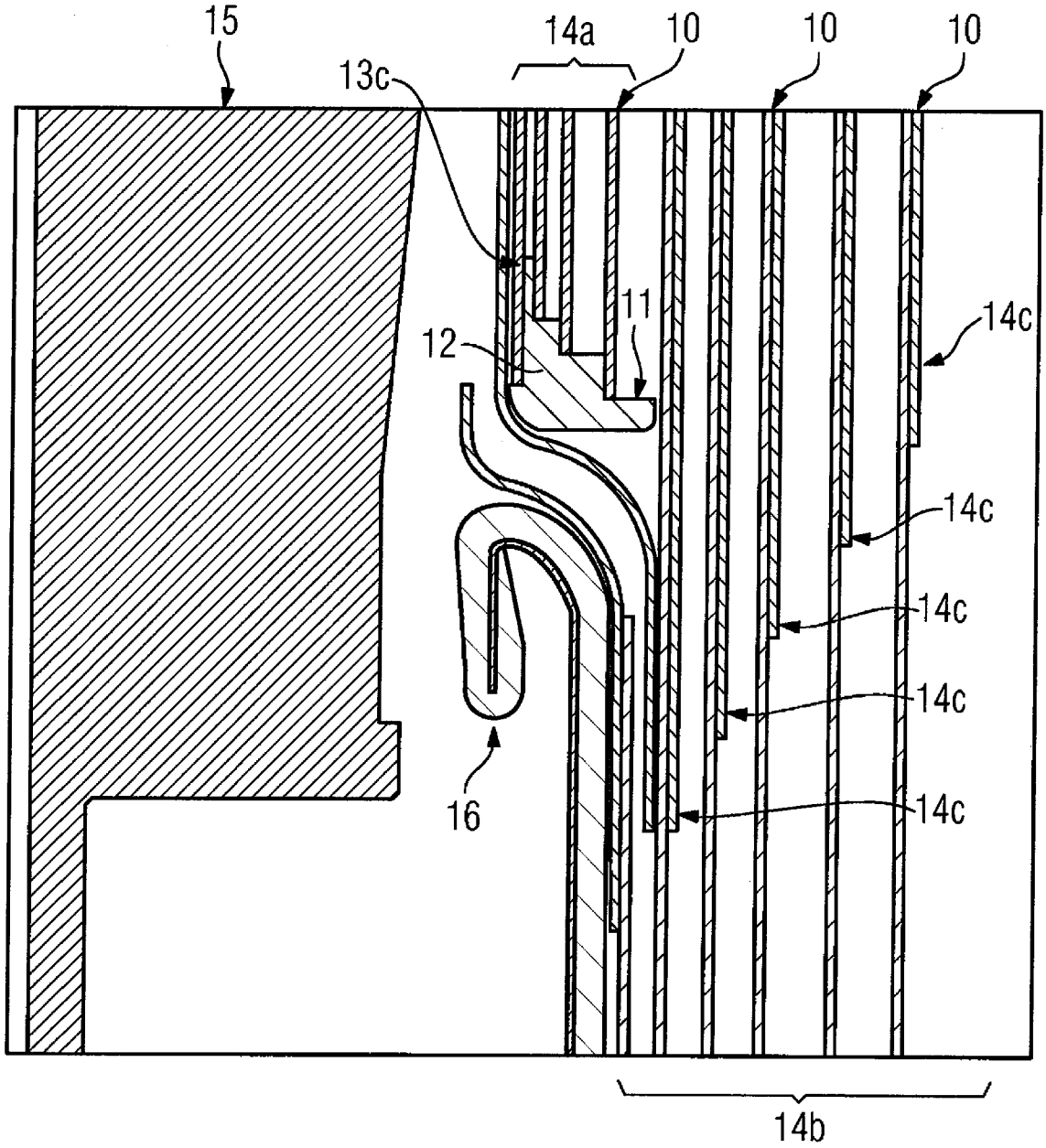
FIG. 1 shows a schematic layout of the barrier system according to the invention, with three plug groups.

FIG. 1 shows a schematic section drawing of a detail of the barrier system according to the invention around a line bushing 15 of an electrical installation. The outer area of the line bushing 15 is shielded by an electrode 16 which is bent around at the end. A first plug group 14*a* of wall elements 10 is fitted on the electrode 16. The distances between the wall elements 10 are predetermined by individual slots on the plug element 12. The distances between the wall elements 10 are to be maintained because of the requirement for cooling and the electrical field strengths there, and is ensured on the basis of the arrangement of the slots on the plug element 12.

A plug group 14*a* of wall elements 10 is indicated by a number of wall elements 10, which run virtually parallel, and spacers(not shown) on the side facing away from the plug element 12. The spacers ensure that the distance between predetermined wall elements 10 is identical to the distance between the corresponding slots on the plug element 12. Fixed and permanent retention and fixing of the relative position of the wall elements 10 are therefore ensured in the cap area 11 of the plug group 14*a* by the plug element 12 and, in the end of the plug group 14*a* facing away from the plug element 12, by the spacers.

A third plug group 14*c* can be plugged into a second plug group 14*b*, in which case the wall element 10 of the third plug group 14*c* can be connected in a corresponding manner to the wall elements 10 of the second plug group 14*b*. Locking of the third plug group 14*c* is ensured by the strength and dimensional stiffness of the plug groups 14*b*, 14*c*, in particular by the insertion of the third plug group 14*c* into the second plug group 14*b*, with virtually identical distances between the respective wall elements 10. The first plug group 14*a* is locked within the plug element 12 according to the invention in the immediate vicinity of the line bushing 15. The distances between the guide elements 13*a*, 13*b*, 13*c* at the same time define the distance between the wall elements 10.

Axial staggering of the wall elements 10 relative to one another may also be necessary because of particular requirements relating to the surrounding electrical field.

In the upper area (which cannot be seen) of the wall elements 10, the wall elements 10 are fixed by conventional spacers (not shown), for example pressboard blocks. The capability to plug in the plug groups 14*a*, 14*b*, 14*c* allows a modular design as well as allowing the barrier arrangement to be fitted and removed quickly.

FIG. 2*a* to FIG. 2*e* show different section forms of the plug elements 12. The number of wall elements 10 per plug group 14*a*, 14*b*, 14*c* is considered for the corresponding plug element 12. In the examples in FIG. 2*a* and FIG. 2*b*, the distances between the respective wall elements 10 are, furthermore, chosen to be different, because of the requirement relating to the external electrical field. On the left-hand side of the plug element 12, facing the line bushing 15, the distances between the slots and therefore between the wall elements to be inserted are small, because of the high electrical field strengths to be expected. As the distance from the line bushing 15 increases, the distances between the slots at the right-hand edge of the plug element 12 become greater relative to the distances at the left-hand edge of the plug element 12.

Figure 2A:
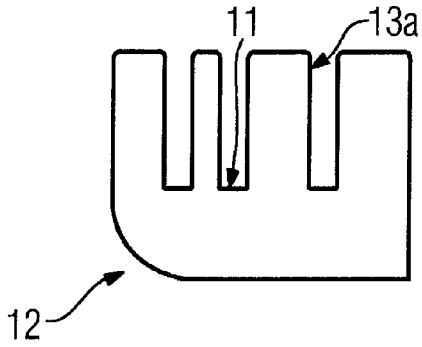
FIGS. 2*a* to 2*e* show section drawings of plug elements according to the invention.
Figure 2B:
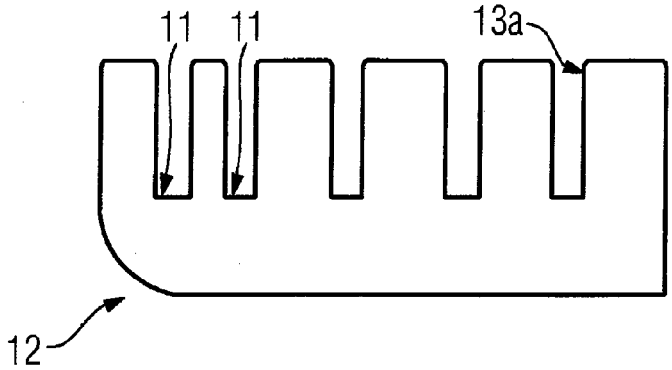
Figure 2C:
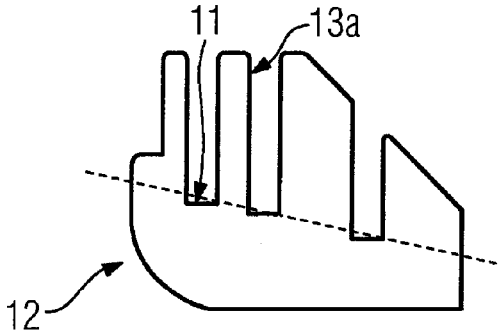
Figure 2D:
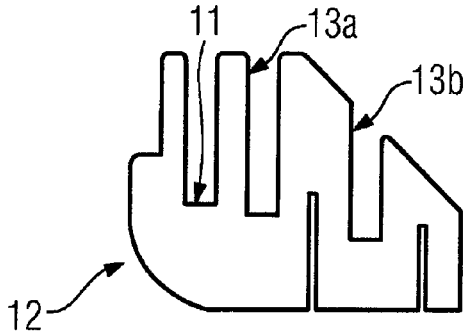
Figure 2E:
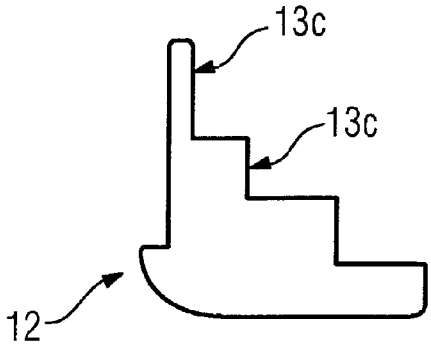

Furthermore, in the embodiments shown in FIG. 2*c* and FIG. 2*d*, the shapes of the guide elements 13*a*, 13*b*, 13*c* are slightly inclined in order to ensure better circulation of the coolant in the vicinity of the plug element 12. Other geometric shapes are likewise also claimed, so that the present drawings do not imply any restriction to the shape illustrated in them. FIG. 2*e* shows a plug element 12 according to the invention on which the wall elements 10 are not held by means of slots, but exclusively by means of the guide element 13*c* itself. For security, the wall elements 10 are fixed to this guide element 13*c* by attachment elements (not illustrated), such as screws, pins or rivets.

The invention claimed is:

1. A barrier system for a line bushing of an electrical installation, comprising:

a plurality of wall elements disposed alongside one another and forming barriers, said wall elements having axial longitudinal extents and being disposed at a spacing distance from one another, with intermediate spaces formed thereby defining channels for circulation of a medium;

a plug element forming a base for said wall elements, said plug elements having axial guide elements for permanently holding and fixing said wall elements, with said wall elements resting in places on said base at least with a lower end thereof.

2. The barrier system according to claim 1, wherein said guide elements are arranged on said plug element such that said wall elements connected to said guide elements are disposed at a predetermined distance from one another.

3. The barrier system according to claim 1, wherein said guide elements are formed with caps and said caps of said guide elements are disposed at different heights relative to one another on said plug element, whereby said wall elements are axially staggered.

4. The barrier system according to claim 1, wherein said plug element has slots formed between said guide elements configured to receive said wall elements in a plug connection.

5. The barrier system according to claim 1, wherein said wall elements are combined to form plug groups, and some of said plug groups can be connected to said plug element.

6. The barrier system according to claim 5, wherein said plug groups are plugged into one another by way of said wall elements.

7. The barrier system according to claim 1, wherein said wall elements are composed of pressboard.

8. The barrier system according to claim 1, which further comprises attachment elements for fixing said wall elements to said guide elements.

9. The barrier system according to claim 1, wherein said plug element is configured for connection to the line bushing of the electrical installation.

10. The barrier system according to claim 9, wherein said wall elements are formed with slots configured to connect said plug element to the line bushing of the electrical installation.

11. The barrier system according to claim 1, wherein said guide elements are shaped to not adversely affect a circulation of a medium within said channels.

12. The barrier system according to claim 1, wherein said plug element is formed as a circumferential ring around the line bushing.

13. The barrier system according to claim 12, wherein said plug element is a circumferential ring formed with voids through which the medium circulates.

14. The barrier system according to claim 13, wherein said voids are holes.

15. The barrier system according to claim 1, wherein said plug element is one of a plurality of plug elements arranged circumferentially around the line bushing, with said plug elements having a negligible radial extent in comparison to the line bushing and substantially not interfering with a circulation of the medium along said wall elements around the line bushing.

16. A plug element assembly comprising:

a plug element configured for permanently holding and fixing wall elements disposed alongside one another and forming barriers in a barrier system for a line bushing of an electrical installation, the wall elements having axial longitudinal extents and being arranged at spacing intervals from one another, with intermediate spaces formed thereby defining channels for circulation of a medium and the wall elements resting on the plug element, at least at a lower end of the wall elements, wherein some of the wall elements can be connected to the plug element, with the plug element having axial guide elements.

17. The plug element according to claim 16, wherein said axial guide elements are slots and corresponding wall elements can be plugged into said slots.

* * * * *